US008514259B2

(12) United States Patent
Yokoi

(10) Patent No.: US 8,514,259 B2
(45) Date of Patent: Aug. 20, 2013

(54) IMAGE FORMING APPARATUS

(75) Inventor: Junichi Yokoi, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/367,243

(22) Filed: Feb. 6, 2012

(65) Prior Publication Data

US 2012/0224162 A1 Sep. 6, 2012

(30) Foreign Application Priority Data

Mar. 1, 2011 (JP) ..... 2011-044499

(51) Int. Cl.
*B41J 2/435* (2006.01)

(52) U.S. Cl.
USPC ..... 347/234; 347/248

(58) Field of Classification Search
USPC ..... 347/116, 234, 235, 248–250
See application file for complete search history.

(56) References Cited

U.S. PATENT DOCUMENTS

| | | | | |
|---|---|---|---|---|
| 6,011,575 | A | 1/2000 | Haneda | |
| 6,118,463 | A | 9/2000 | Houki et al. | |
| 6,163,334 | A | 12/2000 | Irie et al. | |
| 8,207,994 | B2 * | 6/2012 | Ohno | 347/238 |
| 2003/0076402 | A1 * | 4/2003 | Asakura | 347/234 |
| 2011/0080617 | A1 * | 4/2011 | Sato et al. | 358/3.26 |

FOREIGN PATENT DOCUMENTS

| | | | |
|---|---|---|---|
| JP | H05-084972 | A | 4/1993 |
| JP | H10-138563 | A | 5/1998 |
| JP | H10-272803 | A | 10/1998 |
| JP | H10-315545 | A | 12/1998 |
| JP | H11-129526 | A | 5/1999 |
| JP | 2000-037910 | A | 2/2000 |
| JP | 2002-108043 | A | 4/2002 |
| JP | 2004-198526 | A | 7/2004 |
| JP | 2005-096364 | A | 4/2005 |
| JP | 2006-091467 | A | 4/2006 |
| JP | 2010-008701 | A | 1/2010 |
| JP | 2010-079170 | A | 4/2010 |
| JP | 2010-156752 | A | 7/2010 |

OTHER PUBLICATIONS

Japan Patent Office, Decision of Grant for Patent for Japanese Patent Application No. 2011-044499 (counterpart Japanese patent application), mailed Mar. 19, 2013.

* cited by examiner

*Primary Examiner* — Hai C Pham
(74) *Attorney, Agent, or Firm* — Baker Botts L.L.P.

(57) ABSTRACT

Positions in a main scanning direction of points of exposure are determined by emission of light from two light-emitting points of each exposure device near predetermined endmost light-emitting points. A first exposure device of which a distance between the two light-emitting points is greatest is identified based on the determined positions of the points of exposure. A subset of usable light-emitting points of a second exposure device other than the first exposure device, located in positions corresponding to a range of exposure which coincides in a width direction with a range of exposure defined by the two light-emitting points of the first exposure device, is specified The number n of pairs of adjacent usable light-emitting points of the second exposure device each associated with one pixel is obtained by subtracting the number of usable light-emitting points of the first exposure device from that of the second exposure device.

7 Claims, 11 Drawing Sheets

IMAGE FORMING APPARATUS

CROSS-REFERENCE TO RELATED APPLICATION(S)

This application claims priority from Japanese Patent Application No. 2011-044499, filed on Mar. 1, 2011, the disclosure of which is incorporated herein by reference in its entirety.

BACKGROUND

1. Field

The present invention relates to image forming apparatuses, and particularly to an electrophotographic image forming apparatus comprising a plurality of exposure devices each having a plurality of light-emitting points arranged in a main scanning direction.

2. Description of Related Art

In an electrophotographic image forming apparatus, a photoconductor is exposed to light to form an electrostatic latent image on the photoconductor. In recent years, an exposure device including an exposure head having a plurality of light-emitting points, as implemented by light-emitting diodes (LEDs) or the like, arranged in a main scanning direction (i.e., the direction perpendicular to the direction of transport of a sheet on which an image is to be formed) has been provided for use in this exposure process.

In a color image forming apparatus, a plurality of such exposure heads are provided for a plurality of print colors such as cyan, magenta, etc. In order to prevent displacements of images foamed by the exposure heads, a color displacement correction may be performed.

The exposure head is typically configured to include a plurality of light-emitting chips arranged in the main scanning direction on a circuit board, and each light-emitting chip may be an LED array chip fabricated through a semiconductor process in which a plurality of LEDs as light-emitting elements are arranged precisely in a single row and packaged in a single semiconductor chip. To be more specific, the LED array chips are arranged in the main scanning direction on the circuit board in such a manner that adjacent LED array chips are in positions shifted from each other in a sub scanning direction that is perpendicular to the main scanning direction so as to prevent a gap in the main scanning direction from being left between a light-emitting point at an end of one chip and a light-emitting point at an opposite end (closer to the one chip) of another chip adjacent to the one chip.

Although each LED array chip fabricated through the semiconductor process has a plurality of light-emitting points very precisely aligned thereon, some error would be introduced in the assembly process for mounting the LED array chip on the circuit board. Moreover, there would also be an error introduced in the assembly process for mounting the exposure head to the body of the image forming apparatus. As a result, when a plurality of exposure heads are activated so that light is emitted from the same number of light-emitting points in all the exposure heads, regions on the photoconductor exposed to light emitted from the exposure heads would disadvantageously be misaligned with each other in the main scanning direction.

Under the circumstances, there is a need to provide an image forming apparatus which can achieve neat alignment in the main scanning direction of regions on a photoconductor exposed to light emitted from a plurality of exposure heads, whereby a quality color image can be formed.

The present invention has been made in an attempt to address the aforementioned problem in prior art.

SUMMARY

In one aspect of the present invention, an image forming apparatus is provided which comprises a plurality of exposure devices, a photoconductor, and a controller. Each of the plurality of exposure devices has a plurality of light-emitting points arranged in a main scanning direction. The photoconductor is configured to be exposed to light emitted from the exposure devices whereby an electrostatic latent image is formed thereon. The controller is configured to control emission of the exposure devices, and includes an end-pixel location unit, a maximum-width exposure device identification unit, a light-emitting point specification unit, and a light-emitting point association unit. The end-pixel location unit is configured to determine positions in the main scanning direction of points of exposure to be formed on the photoconductor by emission of light from two light-emitting points of each exposure device, the two light-emitting points being in predetermined positions near endmost light-emitting points of a predetermined number of light-emitting points the number of which corresponds to the number of pixels to be arranged in a printable width. The maximum-width exposure device identification unit is configured to identify a first exposure device of which a distance between the two light-emitting points is greatest of all the exposure devices, based on the positions of the points of exposure determined by the end-pixel location unit. The light-emitting point specification unit is configured to specify a subset of usable light-emitting points of a second exposure device other than the first exposure device identified by the maximum-width exposure device identification unit, the specified subset of usable light-emitting points being located in positions corresponding to a range of exposure which coincides in a width direction with a range of exposure defined by the two light-emitting points of the first exposure device. The light-emitting point association unit is configured to associate the subset of usable light-emitting points specified by the light-emitting point specification unit with pixels of input image data, wherein n pairs of adjacent usable light-emitting points of the second exposure device are each associated with one pixel, and the number n of the pairs of adjacent usable light-emitting points is obtained by subtracting the number of usable light-emitting points of the first exposure device from the number of the usable light-emitting points of the second exposure device.

BRIEF DESCRIPTION OF THE DRAWINGS

The above aspect, its advantages and further features of the present invention will become more apparent by describing in detail illustrative, non-limiting embodiments thereof with reference to the accompanying drawings, in which.

DESCRIPTION OF EMBODIMENTS

<General Setup of Laser Printer>

Figure 1:
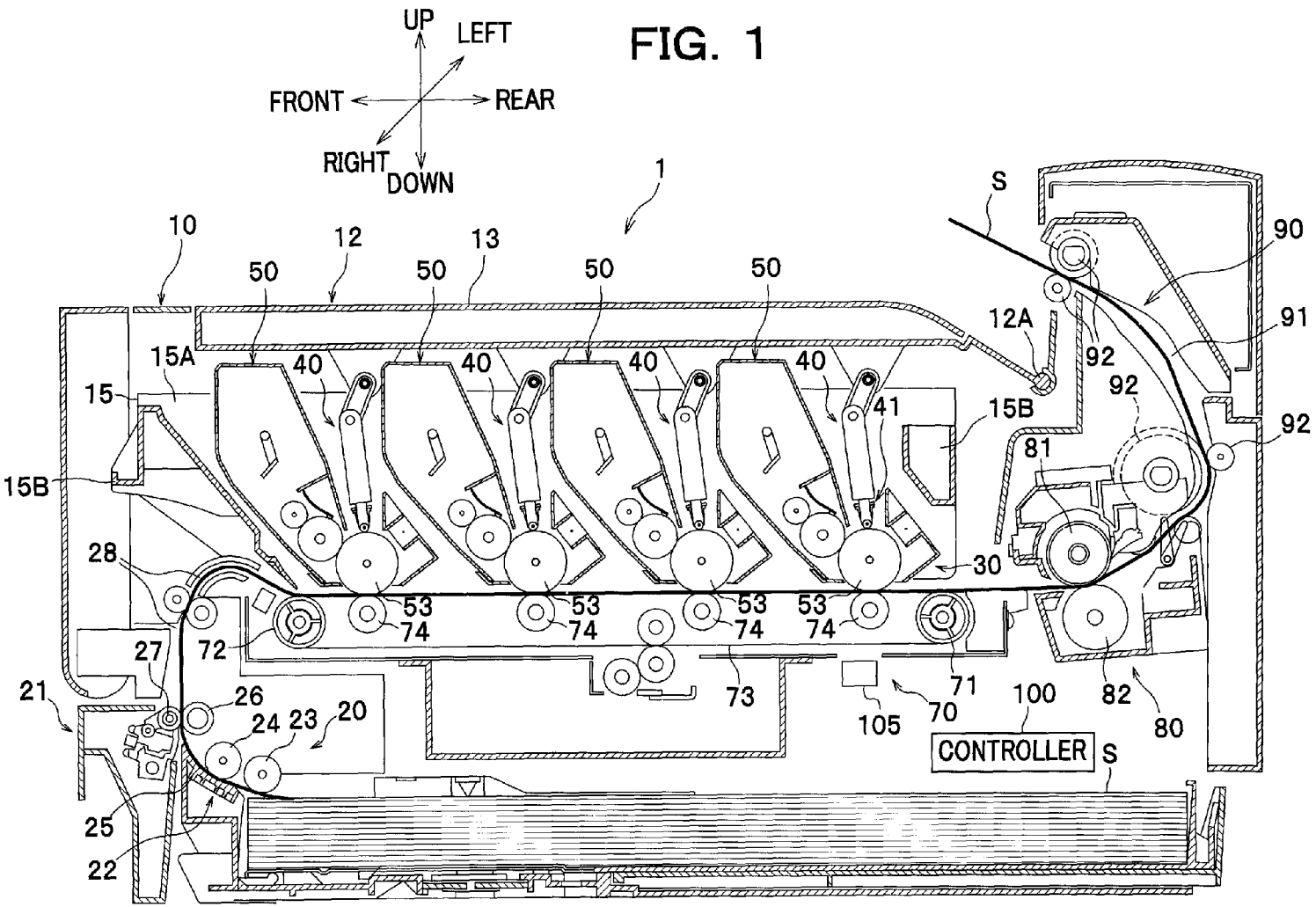
FIG. 1 is a vertical section showing a general configuration of a color printer as an example of an image forming apparatus according to an illustrative embodiment of the present invention.

As shown in FIG. 1, an electrophotographic color printer 1 as an example of an image forming apparatus according to an illustrative embodiment of the present invention includes a body casing 10 and other components housed within the body casing 10 which principally include a sheet feeder unit 20 configured to feed a sheet S (e.g., of paper, or other type of recording sheet), an image forming unit 30 configured to form an image on the sheet S fed by the sheet feeder unit 20, a sheet output unit 90 configured to eject the sheet S on which an image has been formed by the image forming unit 30, and a controller 100 configured to control operations of these components. In the following description, the direction is designated as from the viewpoint of a user who is using (operating) the color printer 1. To be more specific, in FIG. 1, the left-hand side of the drawing sheet corresponds to the "front" side of the color printer 1, the right-hand side of the drawing sheet corresponds to the "rear" side of the color printer 1, the back side of the drawing sheet corresponds to the "left" side of the color printer 1, and the front side of the drawing sheet corresponds to the "right" side of the color printer 1. Similarly, the direction of a line extending from top to bottom of the drawing sheet corresponds to the "vertical" or "upward/downward (upper/lower or top/bottom)" direction of the color printer 1.

At an upper portion of the body casing 10, an upper cover 12 is provided. The upper cover 12 is pivoted on the body casing 10 so that the upper side of the body casing 10 can be opened and closed as desired by causing the upper cover 12 to be swung open and closed on a hinge 12A provided at a rear side thereof. An upper surface of the upper cover 12 is configured as a sheet output tray 13 on which sheets S ejected from inside of the body casing 10 are stacked and accumulated. At an undersurface of the upper cover 12, four LED units 40 each configured as an exposure device consistent with the present invention are provided.

In the body casing 10, a cartridge drawer 15 in which a plurality of process cartridges 50 are accommodated in such a manner that each process cartridge 50 is removable from and installable in the cartridge drawer 15. The cartridge drawer 15 includes a pair of right and left side plates 15A (of which only one is illustrated) made of metal and a pair of front and rear cross members 15B connecting the side plates 15A. The side plates 15A are disposed at right and left sides of LED heads 41 each configured as an exposure head included in each of a plurality of LED units 40, and configured to directly or indirectly support and locate photoconductor drums 53 in place. Emission of each LED head 41 is controlled by a controller 100.

The sheet feeder unit 20, provided in a lower space within the body casing 10, principally includes a sheet feed tray 21 removably installed in the body casing 10, and a sheet feed mechanism 22 configured to feed a sheet S from the sheet feed tray 21 to the image forming unit 30. The sheet feed mechanism 22, provided frontwardly of the sheet feed tray 21, principally includes a sheet feed roller 23, a separation roller 24 and a separation pad 25.

In the sheet feeder unit 20 configured as described above, sheets S in the sheet feed tray 21 are separated and fed upward one after another by the sheet feed mechanism 22. Each sheet S thus fed upward is passed through between a paper powder remover roller 26 and a pinch roller 27 so that paper powder is removed from each sheet S. Thereafter, the sheet S is conveyed through a sheet conveyance path 28 in which a direction of conveyance of the sheet S is changed to the rearward, so that the sheet S is provided into the image forming unit 30.

The image forming unit 30 principally includes four LED units 40, four process cartridges 50, a transfer unit 70 and a fixing unit 80.

Figure 2:
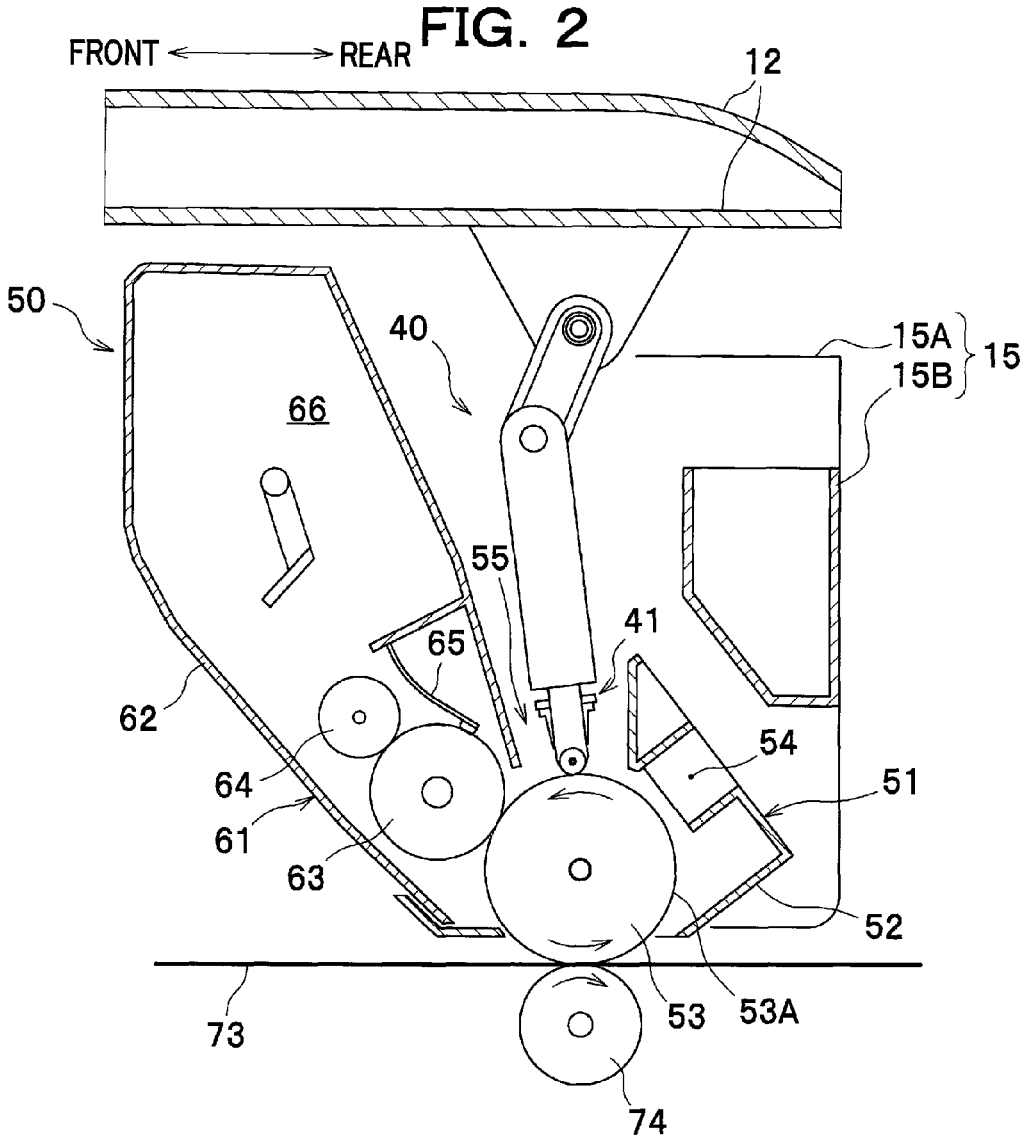
FIG. 2 is an enlarged view of an LED unit and a process cartridge.

The process cartridges 50 are disposed between the upper cover 12 and the sheet feeder unit 20 and arranged in tandem in the front-rear direction. As shown in FIG. 2, each of the process cartridges 50 includes a drum unit 51 and a development unit 61 detachably attached to the drum unit 51. The side plates 15A support the process cartridges 50, and each process cartridge 50 supports a corresponding photoconductor drum 53.

The process cartridges 50 are different from each other only in color of toner contained in their toner reservoirs 66, and have the same structure.

The drum unit 51 principally includes a drum frame 52, a photoconductor drum 53 as an example of a photoconductor, and a scorotron charger 54. The photoconductor drum 53 is rotatably supported by the drum frame 52.

The development unit 61 includes a development frame 62, a development roller 63, a supply roller 64, and a doctor blade 65. The development roller 63 and the supply roller 64 are rotatably supported by the development frame 62. The development unit 61 further includes a toner reservoir 66 which contains toner. The process cartridge 50 is configured such that the development unit 61 is attached to the drum unit 51 so that an exposure hole 55 positioned directly above the photoconductor drum 53 is formed between the development frame 62 and the drum frame 52. The LED unit 40 with an LED head 41 held at its lower end is inserted through the exposure hole 55 from above. The structure of the LED head 41 will be described later in detail.

The transfer unit 70 is, as shown in FIG. 1, disposed between the sheet feeder unit 20 and the process cartridges 50, and principally includes a driving roller 71, a driven roller 72, a conveyor belt 73, and transfer rollers 74.

The driving roller 71 and the driven roller 72 are disposed parallel to each other and separate from each other in the front-rear direction. The conveyor belt 73 is an endless belt looped around the driving roller 71 and the driven roller 72. The conveyor belt 73 has an outer surface in contact with each of the photoconductor drums 53. Four transfer rollers 74 are disposed inside the conveyor belt 73 in positions opposite to the corresponding photoconductor drums 53 so that the conveyor belt 73 is held between the transfer rollers 74 and the corresponding photoconductor drums 53. A developing bias is applied to each of the development rollers 74 under a constant-current regulating control scheme during a transfer operation.

Under the conveyor belt 73, image sensors 105 are provided which face an undersurface (outer surface) of the conveyor belt 73. Each image sensor 105 includes an LED, a phototransistor and other components, and is configured to detect toner carried on the conveyor belt 73 for testing (so-called "patch test"). Two image sensors 105 are disposed in positions near both ends, in the width direction of the sheet S (main scanning direction), of an image formation region so that the image sensors 105 can detect toner carried at these positions. The image sensors 105 are not necessarily located under the conveyor belt 73 but may be in any positions (e.g., at the front or rear side thereof) as long as the sensors 105 are positioned to face the outer surfaces of the conveyor belt 73.

The fixing unit 80 is disposed rearward of the process cartridges 50 and the transfer unit 70. The fixing unit 80 principally includes a heating roller 81, and a pressure roller 82 disposed opposite to the heating roller 81 and configured to be pressed against the heating roller 81.

Operation in the image forming unit 30 configured as described above is as follows. First, the surface (photosensitive surface 53A) of each photoconductor drum 53 is uniformly charged by the scorotron charger 54, and then exposed to LED light emitted from the corresponding LED head 41. Thereby, an electric potential of exposed portions is lowered so that an electrostatic latent image based upon image data is formed on the surface of each photoconductor drum 53.

Toner in the toner reservoir 66 is supplied by the rotating supply roller 64 to the development roller 63, and as the development roller 63 rotates, passes through an interface between the development roller 63 and the doctor blade 65 so that a thin layer of toner having a predetermined thickness is carried on the development roller 63.

Toner carried on the development roller 63 is brought into contact with the surface of the photoconductor drum 53 when it comes in a position opposite to the photoconductor drum 53 as the development roller 63 rotates, and then is supplied to the electrostatic latent image formed on the surface of the photoconductor drum 53. Thus, the toner is retained selectively on the photoconductor drum 53, so that the electrostatic latent image is visualized and a toner image is formed by the reversal process.

When a sheet S fed onto the conveyor belt 73 is held and passed through between each photoconductor drum 53 and the corresponding transfer roller 74 disposed at the inside of the conveyor belt 73, the toner image formed on the surface of the photoconductor drum 53 is transferred onto the sheet S.

The sheet S is then passed through between the heating roller 81 and the pressure roller 82 in the fixing unit 80, whereby the toner image transferred on the sheet S is fixed by heat. The sheet output unit 90 principally includes an output-side sheet conveyance path 91 extending from an outlet of the fixing unit 80 upward and gently turning frontward, and a plurality of pairs of conveyor rollers 92 configured to convey the sheet S along the output-side sheet conveyance path 91. The sheet S on which a toner image is transferred and thermally fixed is conveyed by the conveyor rollers 92 through the output-side sheet conveyance path 91, and ejected out of the body casing 10 and accumulated on the sheet output tray 13.

<Structure of LED Head>

Figure 3:
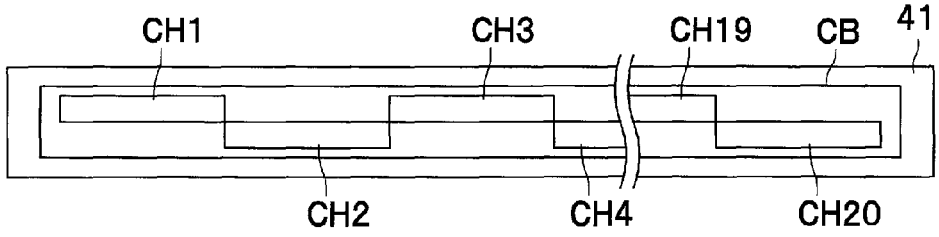
FIG. 3 is a schematic view of the LED unit as viewed from a light-emitting side thereof.

The LED head 41 is a member having a plurality of light-emitting points arranged in a main scanning direction (the direction perpendicular to the direction of transport of a sheet S; in the present embodiment, the right-left direction). The LED head 41 has a light-emitting surface orienting downward to face the photoconductor drum 53. On the light-emitting surface, as shown in FIG. 3, a circuit board CB is provided, on which a plurality of LED array chips $CH_i$ (i is a counting number unique to each LED array chip; i=1, 2, . . . , 20), as an example of a plurality of light-emitting chips, are arranged. Each LED array chip $CH_i$ is composed of very small LED elements formed on a surface thereof by a semiconductor process. In the present embodiment, twenty (20) LED array chips $CH_i$ are arranged on the circuit board CB. The LED elements of the LED array chips $CH_i$ are configured to receive an emission signal from an LED head driver unit 160, which will be described later, to thereby give off light emission sequentially from a scan-start side (e.g., left side of FIG. 7) to a scan-end side (e.g., right side of FIG. 7), or give off light emission in unison, to expose the photoconductor drum 53 to light.

Figure 4:
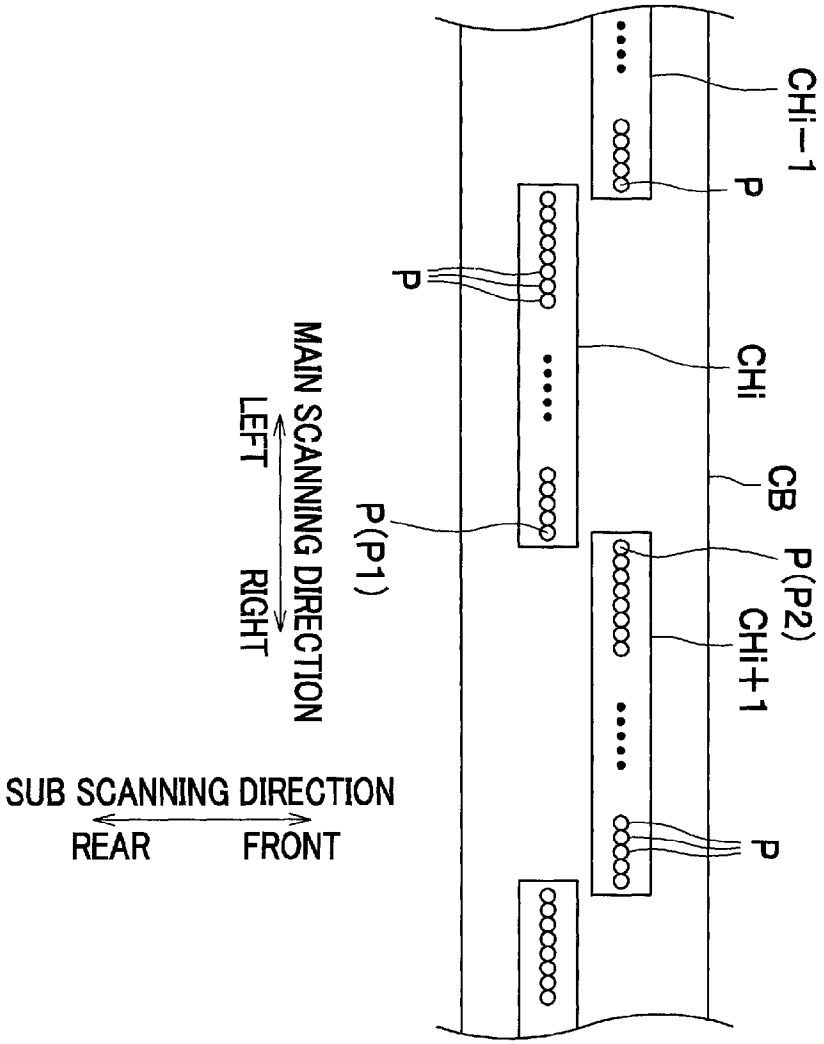
FIG. 4 is an enlarged view of LED array chips provided on the light-emitting side of the LED unit in which light-emitting points arranged thereon.

As shown in FIG. 4, light-emitting points P formed of the LED elements are arranged densely with a predetermined pitch in a row in the main scanning direction on each LED array chip $CH_i$. Due to limitations in fabrication of LED array chip $CH_i$, the light-emitting points P cannot be filled in (i.e., formed at an edge of) each LED array chip $CH_i$. Therefore, in order to achieve uniform pitches between all adjacent light-emitting points P across the chips, the LED array chips $CH_i$ are not aligned with a straight line in the main scanning direction, but arranged such that adjacent LED array chips $CH_i$ are in positions shifted from each other in the sub scanning direction. This makes it possible to arrange a light-emitting point at one end of an LED array chip $CH_i$ (e.g., the light-emitting point P1 at the right end of the LED array chip $CH_i$ in FIG. 4) is in a position shifted in the main scanning direction, properly by one pitch with which the light-emitting points on every LED array chip are arranged, from a light-emitting point at an opposite end of another LED array chip $CH_{i+1}$ adjacent to the one end of the LED array chip $CH_i$ (e.g., the light-emitting point P2 at the left end of the LED array chip $CH_{i+1}$ in FIG. 4). In the present embodiment, adjacent LED array chips $CH_i$ are in positions shifted from each other alternately to the front and to the rear (in the sub scanning direction), i.e., in a staggered arrangement. However, such a staggered arrangement is not requisite; for example, an alternative configuration in which each LED array chip $CH_i$ is located in any one of three positions of the center, the front and the rear so that adjacent LED array chips $CH_i$ are shifted from each other in the front-rear direction.

Although each LED array chip $CH_i$ fabricated through the semiconductor process has a plurality of light-emitting points P very precisely aligned thereon, some error would be introduced in the assembly process for mounting the LED array chip $CH_i$ on the circuit board; therefore, a pitch in the main scanning direction between a light-emitting point at one end of one LED array chip $CH_i$ (e.g., the light-emitting point P1 in FIG. 4) and a light-emitting point at an opposite end of another LED array chip $CH_{i+1}$ adjacent to the LED array chip $CH_i$ (e.g., the light-emitting point P2 in FIG. 4) is deviated from an ideal figure of one pitch to some extent.

Figure 7:
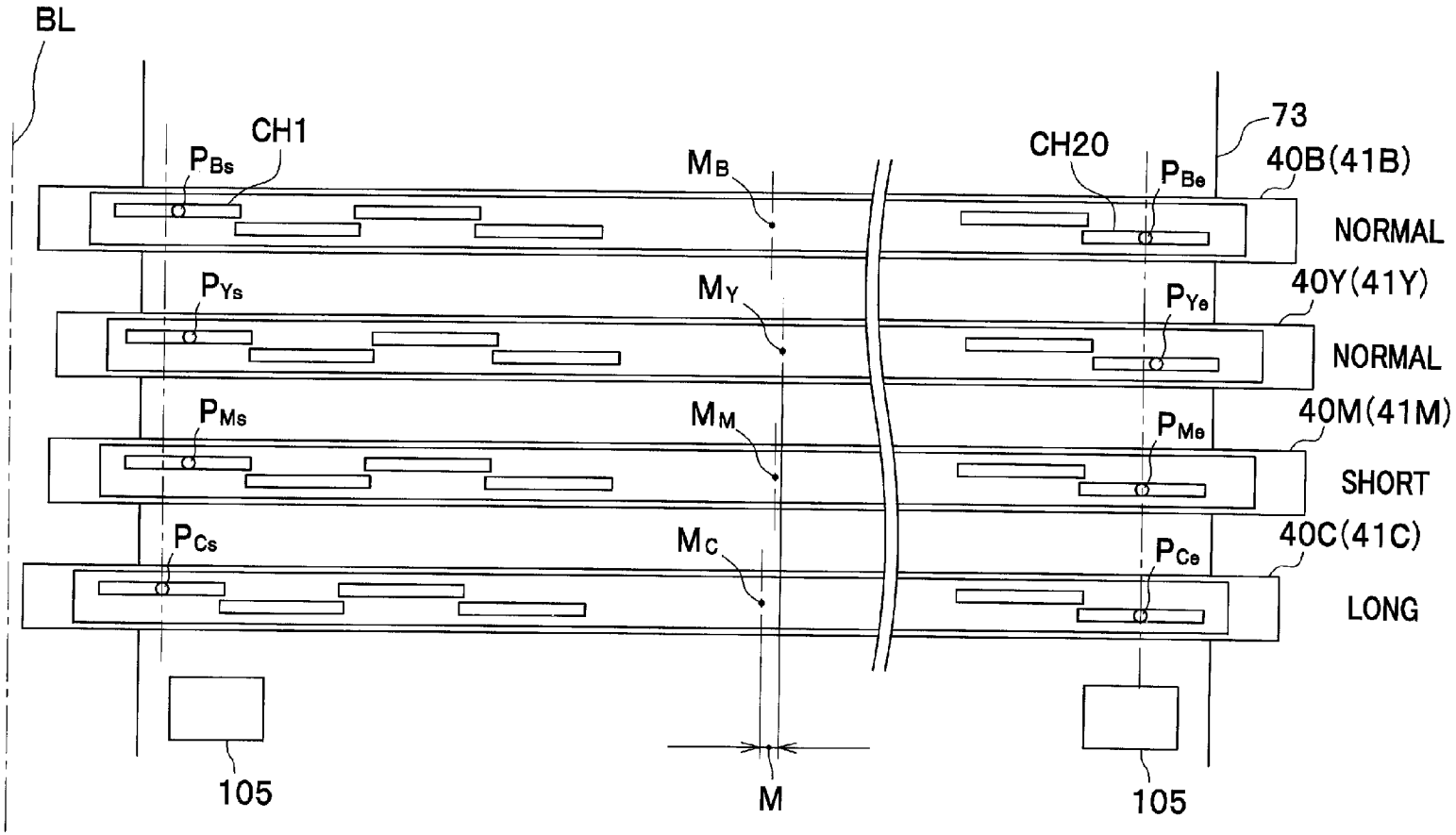
FIG. 7 is a schematic diagram of LED units as viewed from the light-emitting side thereof, illustrated to show an example of positions of light-emitting points near the endmost light-emitting points.

Accordingly, as shown in FIG. 7, when two light-emitting points located in the middle of the endmost LED array chips $CH_1$, $CH_{20}$ on each of the LED heads 41B, 41Y, 41M, 41C corresponding to black (B), yellow (Y), magenta (M) and cyan (C) are caused to give off light emission, the distance between the two light-emitting points are different among the LED heads 41B, 41Y, 41M, 41C. Moreover, as shown in FIG. 7, the positions of the LED heads 41B, 41Y, 41M, 41C in the main scanning direction with respect to a reference plane (body reference plane BL) of the body (body casing 10) of the color printer 1 are different from each other due to error. This error is derived mainly from change in position of each LED head 41B, 41Y, 41M, 41C relative to the body of the color printer 1, which is caused each time when the upper cover 12 is opened or closed. The color printer 1 configured in accordance with the present embodiment is designed to eliminate this error (shift) in the position in the main scanning direction of the light-emitting points P by adjusting the range of light-emitting points P to be used (assigned to pixels of input image data) so as to conform to the range of an image to be printed on the coordinate in the main scanning direction. To this end, the controller 100 of the color printer includes several units as follows.

<Specific Configuration of Controller>

Figure 5:
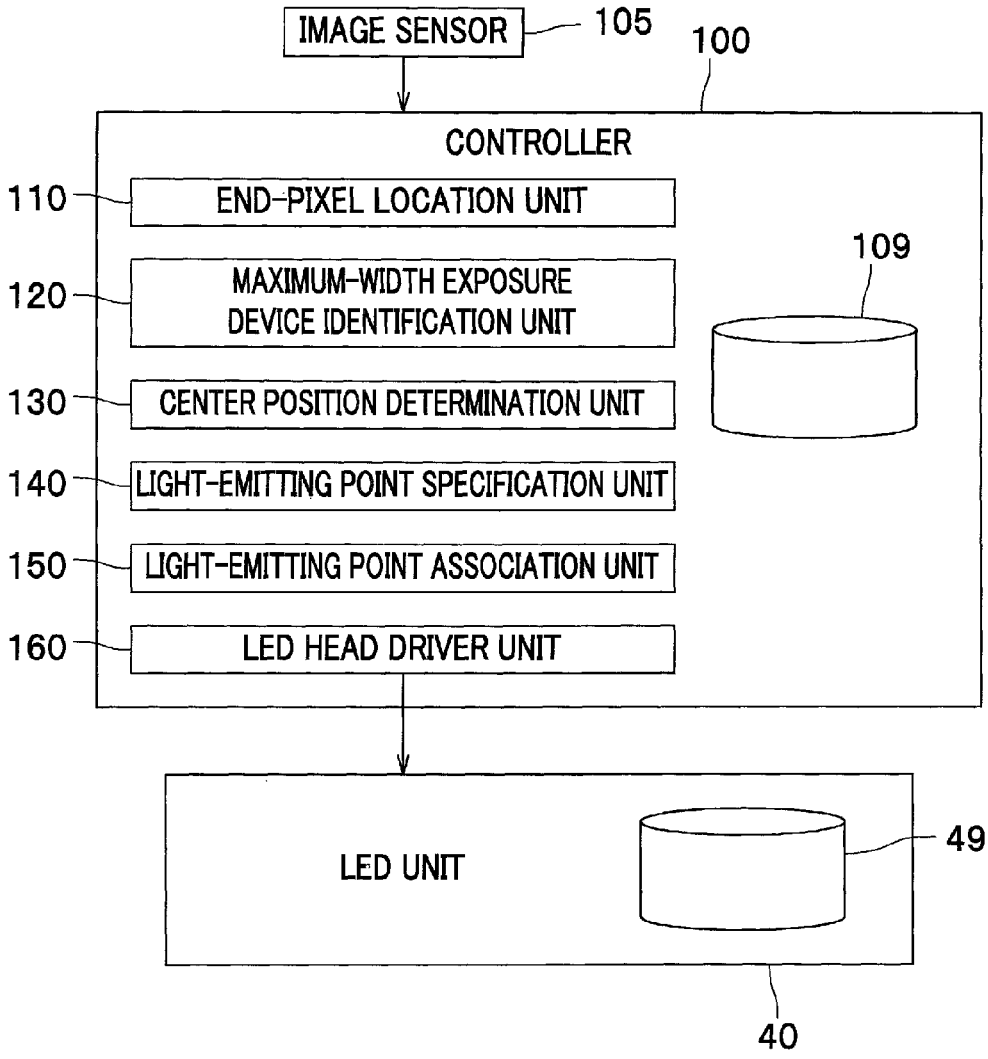
FIG. 5 is a functional block diagram of a controller and an LED unit.

As shown in FIG. 5, the controller 100 includes functional units, as embodied to implement special technical features consistent with the present invention, which are configured to control emission of the LED units 40. Such functional units include an end-pixel location unit 110, a maximum-width exposure device identification unit 120, a center position determination unit 130, a light-emitting point specification unit 140 and a light-emitting point association unit 150, an LED head driver unit 160 and a memory 109. The controller 100 is composed of a central processing unit (CPU), a read-only memory (ROM), a random access memory and an input-output interface, to realize the aforementioned functional units.

Figure 8:
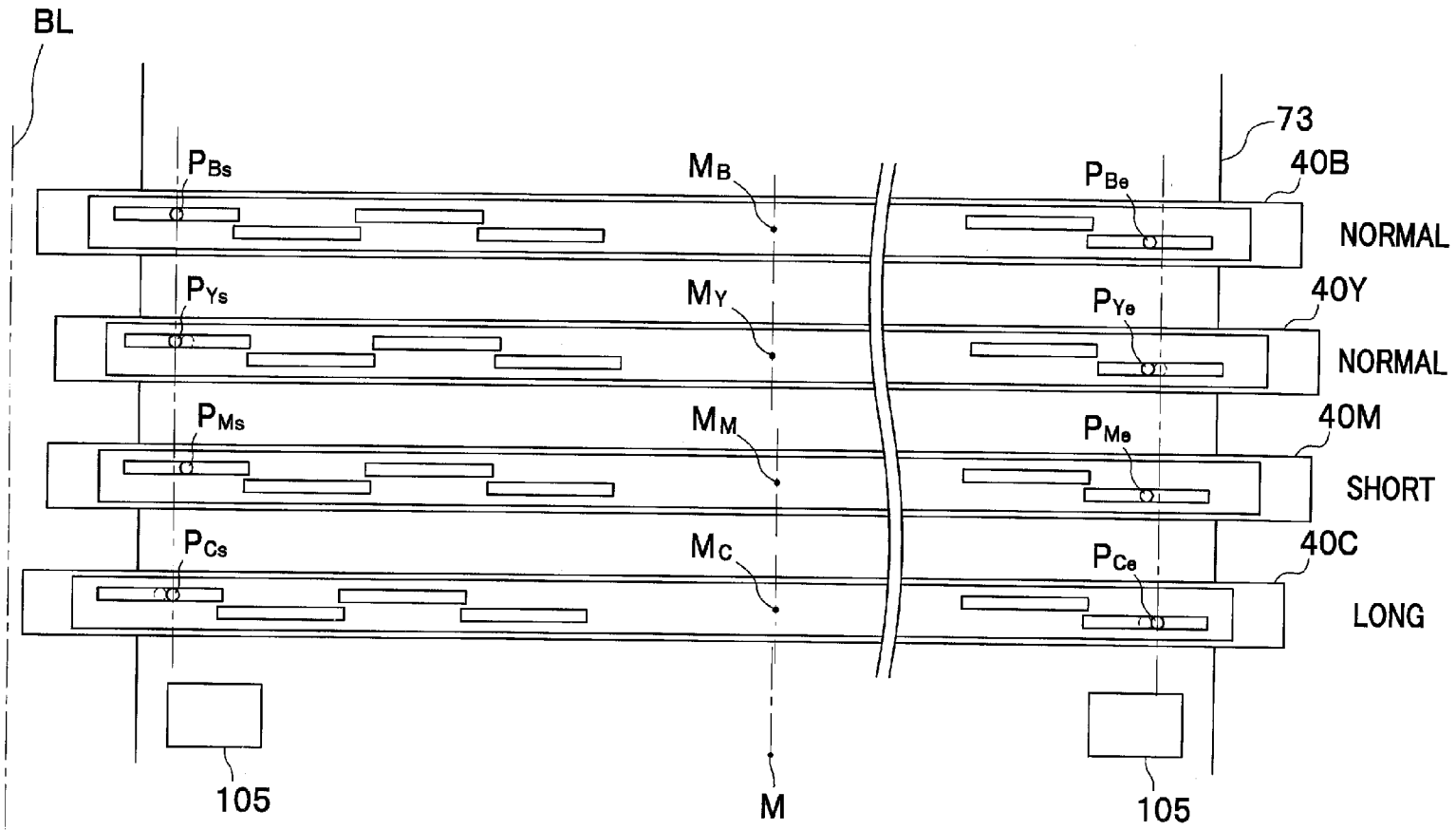
FIG. 8 is a schematic diagram of the LED units as viewed from the light-emitting side thereof, illustrated to explain how to position midpoints in alignment.
Figure 9:
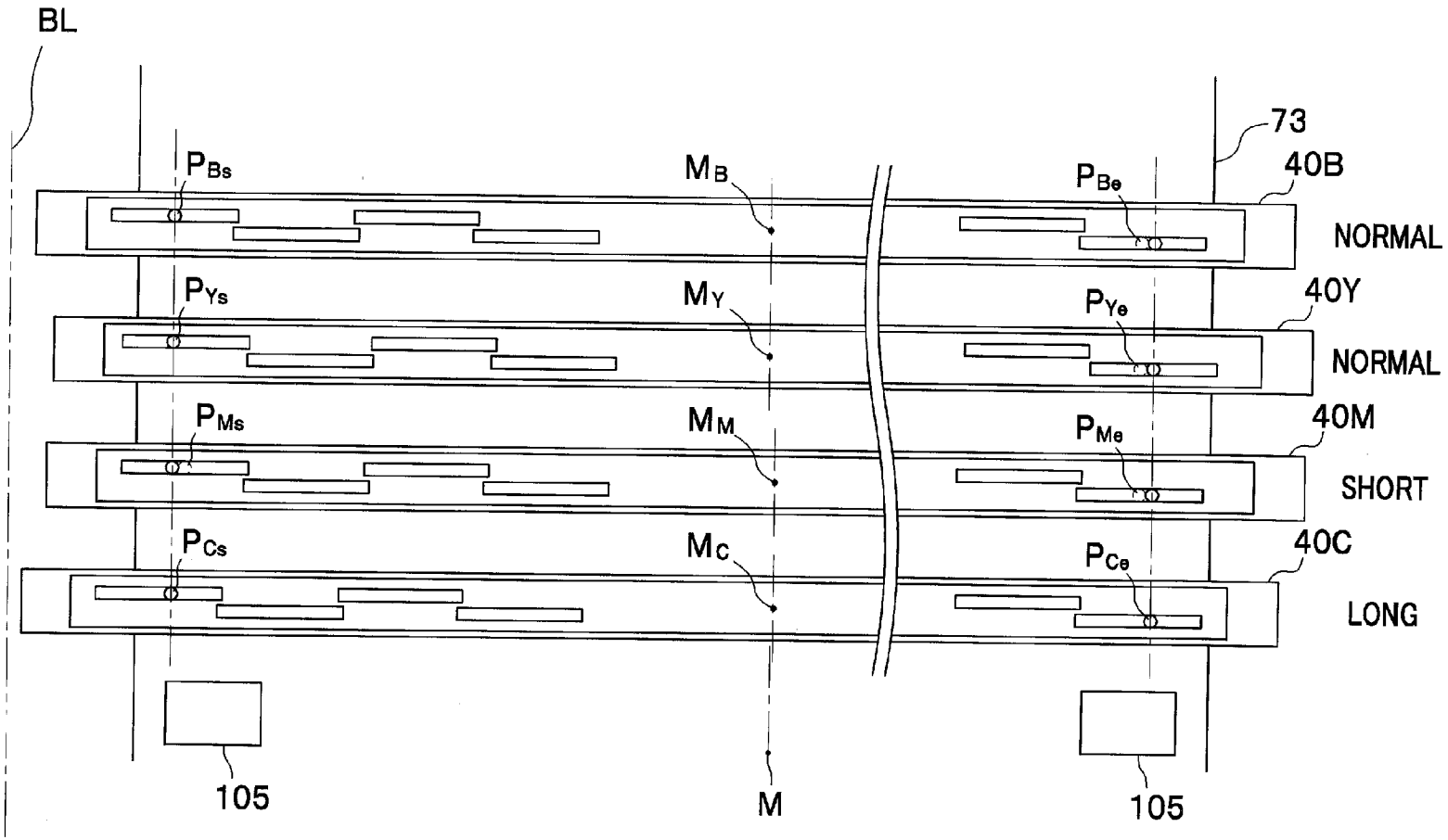
FIG. 9 is a schematic diagram of the LED units as viewed from the light-emitting side thereof, illustrated to explain how to adjust a range of usable light-emitting points for each LED unit.

In FIGS. 7-9 referred to in the following description, the conveyor belt 73 is illustrated just for reference purposes regardless of how it appears in actuality so that the sizes in the width direction of the LED heads 41 can be apprehended. Also in FIGS. 7-9, distances between two light-emitting points which are located in the middle of the endmost LED array chips $CH_1$, $CH_{20}$ are evaluated and labeled as "NORMAL", "SHORT" and "LONG", and the positions of midpoints between the two light-emitting points located in the middle of the endmost LED array chips $CH_1$, $CH_{20}$ are indicated by midpoints $M_B$, $M_Y$, $M_M$ and $M_C$.

The end-pixel location unit 10 is configured to determine positions in the main scanning direction of points of exposure to be formed on the photoconductor drum 53 by emission of light from two light-emitting points P of each of the four LED units 40. The two light-emitting points P are predetermined light-emitting points which are in predetermined positions near endmost light-emitting points of a predetermined number of light-emitting points the number of which corresponds to the number of pixels to be arranged in a printable width (i.e., the maximum width across which the color printer 1 can form an image on a sheet S having a maximum printable size). In describing the present embodiment, one of the two light-emitting points P (left in FIG. 7) is referred to as a start-of-emission point $P_{Xs}$ and the other of the two light-emitting points P (right in FIG. 7) is referred to as an end-of-emission point $P_{Xe}$ for convenience's sake wherein the subscript X is a general character to be substituted by B, Y, M and C to represent (by colors) the respective LED units 40B, 40Y, 40M and 40C to which the light-emitting points $P_{Xs}$, $P_{Xe}$ belong. The light-emitting points P located between the start-of-emission point $P_{Xs}$ and the end-of-emission point $P_{Xe}$, inclusive are usable light-emitting points P which are to be used for exposure. Although the start-of-emission point $P_{Xs}$ and the end-of-emission point $P_{Xe}$ are named on the premise that emission occurs from the start-of-emission point $P_{Xs}$ to the end-of-emission point $P_{Xe}$, but it is to be understood that, in actuality, the usable light-emitting points P from the start-of-emission point $P_{Xs}$ to the end-of-emission point $P_{Xe}$ may be caused to give off light emission in unison.

The start-of-emission point $P_{Xs}$ and the end-of-emission point $P_{Xe}$ are predetermined light-emitting points which are in predetermined positions, as described above. In the present embodiment, the start-of-emission point $P_{Xs}$ and the end-of-emission point $P_{Xe}$ are located in the middle of the endmost LED array chips $CH_1$, $CH_{20}$, respectively, of each of the LED heads 41B, 41Y, 41M and 41C. It is to be understood that the start-of-emission point $P_{Xs}$ and the end-of-emission point $P_{Xe}$ may be shifted to correspond to two endmost light-emitting points of a subset of usable light-emitting points P specified by the light-emitting point specification unit, as will be described later.

The end-pixel location unit 110 receives a signal on the positions of pixels (toner) of respective colors on the conveyor belt 73 measured (detected) by the image, sensors 105 and utilizes the received signal to specify (determine) the positions in the main scanning direction of the points of exposure.

The maximum-width exposure device identification unit 120 is configured to identify a first LED unit 40 (first exposure device) of which a distance between the two light-emitting points (the start-of-emission point $P_{Xs}$ and the end-of-emission point $P_{Xe}$) which are caused to give off light emission to determine positions of the points of exposure by the end-pixel location unit 110 is greatest of all the LED units 40. To be more specific, a distance for each LED unit 40 is obtained from a difference between the coordinates in the main scanning direction of the positions of two pixels corresponding to the start-of-emission point $P_{Xs}$ and the end-of-emission point $P_{Xe}$ for each color as detected by the image sensors 105, and a determination is made as to which LED unit 40 has the greatest distance. The distance is not necessarily a specific dimension (spatial distance), but may be a difference between coordinates of the pixels obtained by emission of the start-of-emission point $P_{Xs}$ and the end-of-emission point $P_{Xe}$. In this embodiment as shown in FIGS. 7-9, the first LED unit 40 is the LED unit 40C for cyan.

The center position determination unit 130 is configured to determine a position of a midpoint ($M_B$, $M_Y$, $M_C$, $M_C$) between the positions in the main scanning direction of two points of exposure formed on the photoconductor drum 53 by emission of light from the two light-emitting points (the start-of-emission point $P_{Xs}$ and the end-of-emission point $P_{Xe}$) of each LED unit 40 (40B, 40Y, 40M, 40C) as determined by the end-pixel location unit 110, and to determine a center of an image forming range (reference center point M) by taking a mean between two midpoints which are selected from midpoints $M_X$ ($M_B$, $M_Y$, $M_M$, $M_C$) whose positions are determined for all the LED units 40B, 40Y, 40M, 40C and of which one is located closest to one end (e.g., the midpoint $M_C$ at the leftmost in FIG. 7) and the other is located closest to the other end (e.g., the midpoint $M_Y$ at the rightmost in FIG. 7) in the main scanning direction of the photoconductor drum 53. It is to be understood that the midpoints $M_B$, $M_Y$, $M_M$, $M_C$ are not intended to mean spatial absolute positions as may be determined, but may refer to any values for use in comparison of relative positions in the main scanning direction. For example, the positions of the midpoints $M_B$, $M_Y$, $M_M$, $M_C$ may be mean values of the coordinates in the main scanning direction of the pixels detected by the image sensors 10.

The light-emitting point specification unit 140 is configured to specify a subset of usable light-emitting points of at least one second LED unit 40 (second exposure unit) other than the first LED unit 40 identified by the maximum-width exposure device identification unit 120, the specified subset of usable light-emitting points being located in positions corresponding to a range of exposure which coincides in a width direction with a range of exposure defined by the two light-emitting points (the start-of-emission point $P_{Xs}$ and the end-of-emission point $P_{Xe}$) of the first LED unit 40. In this embodiment as shown in FIGS. 7-9, all of the LED units 40B, 40Y, 40M (for black, yellow and magenta) other than the first LED unit 40C (for cyan) correspond to the second LED units.

In the present embodiment, the range of exposure to light emitted from the usable light-emitting points P of the first LED unit 40 is redefined by shifting the usable light-emitting points P into a range at which the same number of the usable light-emitting points P are assigned to each side in the main scanning direction of the center of the image forming range (reference center point M) determined by the center position determination unit 130, and the subset of usable light-emitting points P located in positions corresponding to the range of exposure which coincides with the redefined range of exposure to light emitted from the usable light-emitting points P of the first LED unit 40 is specified. For example, in FIG. 7, the maximum-width LED unit 40 (the first LED unit 40 of which a distance between the start-of-emission point $P_{Xs}$ and the end-of-emission point $P_{Xe}$ is greatest) is the LED unit 40C for cyan, and this LED unit 40C is in a position deviated to the left with respect to the reference center point M in its entirety. Therefore, the range (subset) of the usable light-emitting points P of the LED unit 40C for cyan is shifted by one to the right, so that the same number of the usable light-emitting points P are assigned to each side (in the main scanning direction) of the reference center point M, as shown in FIG. 8.

The light-light emitting point association unit 150 is configured to associate the usable light-emitting points P of each second LED unit 40B, 40Y, 40M of the subset specified by the light-emitting point specification unit 140 with pixels of input image data, wherein at least one pair of adjacent usable light-emitting points P of each second LED unit 40B, 40Y, 40M is associated with one pixel, and the number n ($n_B$, $n_Y$, $n_M$) of pairs of adjacent usable light-emitting points P of each second LED unit 40B, 40Y, 40M to be associated with one pixel is obtained by subtracting the number of usable light-emitting points P of the first LED unit 40C from the number of the usable light-emitting points P of the second LED unit 40B, 40Y, 40M. In other words, the second LED units 40B, 40Y, 40M has usable light-emitting points P the number of which are greater than that of the first LED unit 40C by $n_B$, $n_Y$, $n_M$, respectively, and some adjacent two light-emitting points P are associated with one pixel of image data to be printed. With this configuration, when a signal (instruction) to the effect that the pixel with which a pair of adjacent two light-emitting points P are associated is turned ON in the image data (i.e., the pixel is assigned to a picture element receiving toner in the image), the associated pair of the adjacent two light-emitting points P are caused to give off light emission in accordance with the instruction.

Determination as to which pair of adjacent light-emitting points P are to be associated with one pixel in the image data may be made in various ways; however, if a pair of light-emitting points to be associated with one pixel were arranged contiguously with another pair of light-emitting points to be associated with one pixel, the resulting image to be printed would likely to appear disturbed at these pixels. Therefore, the light-emitting point association unit 150 is preferably configured such that if the number n of pairs of adjacent usable light-emitting points P of the second LED unit 40 to be associated with one pixel is more than one, the n pairs of adjacent usable light-emitting points P associated with one pixel be located with at least one other light-emitting point interposed between the pairs in that second LED unit 40. In other words, such pairs of adjacent usable light-emitting points P associated with one pixel may preferably be arranged so as not to be contiguous with each other in the main scanning direction.

In the present embodiment, determination as to which pair of adjacent light-emitting points P are to be associated with one pixel in the image data is made based on information on the position in the main scanning direction of each light-emitting point P in each LED unit 40 which have been measured and stored beforehand in the memory 109 (such information is referred to as "linearity data"). The linearity data is used to calculate an amount of deviation of each light-emitting point P of each of the second LED units 40B, 40Y, 40M from the corresponding light-emitting point P of the longest (maximum-width) first LED unit 40C, and the light-emitting point P of the second LED unit 40 having the greatest amount of deviation from the corresponding light-emitting point P of the first LED unit 40 is selected first as a light-emitting point P to be paired with another light emitting point P adjacent thereto, and then subsequent light-emitting points P are selected sequentially in descending order of the amounts of deviation, so that n pairs of adjacent usable light-emitting points P to be associated with one pixel are determined.

In is to be understood that the linearity data may be stored for each light-emitting point, that is, in the form of a piece of information composed of an identifier of each light-emitting point P and the position in the main scanning direction associated with each light-emitting point P. Alternatively, since the light-emitting points P within each LED array chip $CH_i$ are precisely and accurately arranged, the linearity data (information on the position in the main scanning direction) may be stored for each LED array chip $CH_i$ or for any one representative light-emitting point P within each LED array chip $CH_i$. The information on the position of each light-emitting point P may be stored in the form of a coordinate of that position, or as an amount of deviation from a reference position (or an ideal position).

The LED head driver unit 160 is configured to cause the light-emitting points of each LED head 41 to give off light emission based on input image data to be printed. Light emission of each LED head 41 caused by the LED head driver unit 160 is carried out in accordance with association between coordinates in the main scanning direction of pixels (corresponding to picture elements of image data) and light-emitting points P to be caused to give off light emission to form the pixels (corresponding to the picture elements of the image data) on the photoconductor drum 53, and information of such association is stored, for example, in the form of a lookup table in the memory 109 so that the LED head driver unit 160 refers to the lookup table to retrieve such information.

The memory 109 is configured to store data for use in control of light emission of each LED unit 40 exercised by the controller 100. The data stored in the memory 109 may include the aforementioned linearity data, the lookup table (information of association) of coordinates of pixels and light-emitting points P corresponding thereto, and the like, for example.

The controller 100 is configured to activate the end-pixel location unit 110, the maximum-width exposure device identification unit 120, the center position determination unit 130, the light-emitting point specification unit 140, and the light-emitting point association unit 150 as described above only during printing operation in a color printing mode, but not during is printing operation in a monochrome printing mode. During printing operation in the monochrome printing mode, light-emitting points P are associated with pixels of the image data on one-to-one basis by assigning light-emitting points P to pixels of the image data sequentially from a predetermined light-emitting point (e.g., the light-emitting point $P_{Bs}$). This is because the misalignment of pixels between the LED units 40 do not matter by any means during printing operation in the monochrome printing mode, while a plurality of light-emitting points P associated with one pixel of the image data would disadvantageously cause undesired vertical stripes or thicker lines appearing during printing of a uniform tone image.

Operation of determination of light-emitting points associated with pixels and its advantageous effects implemented in the color printer 1 configured as described above will now be described with reference to the flowcharts of FIG. 6 and the schematic diagrams of FIGS. 7-10.

Figure 6:
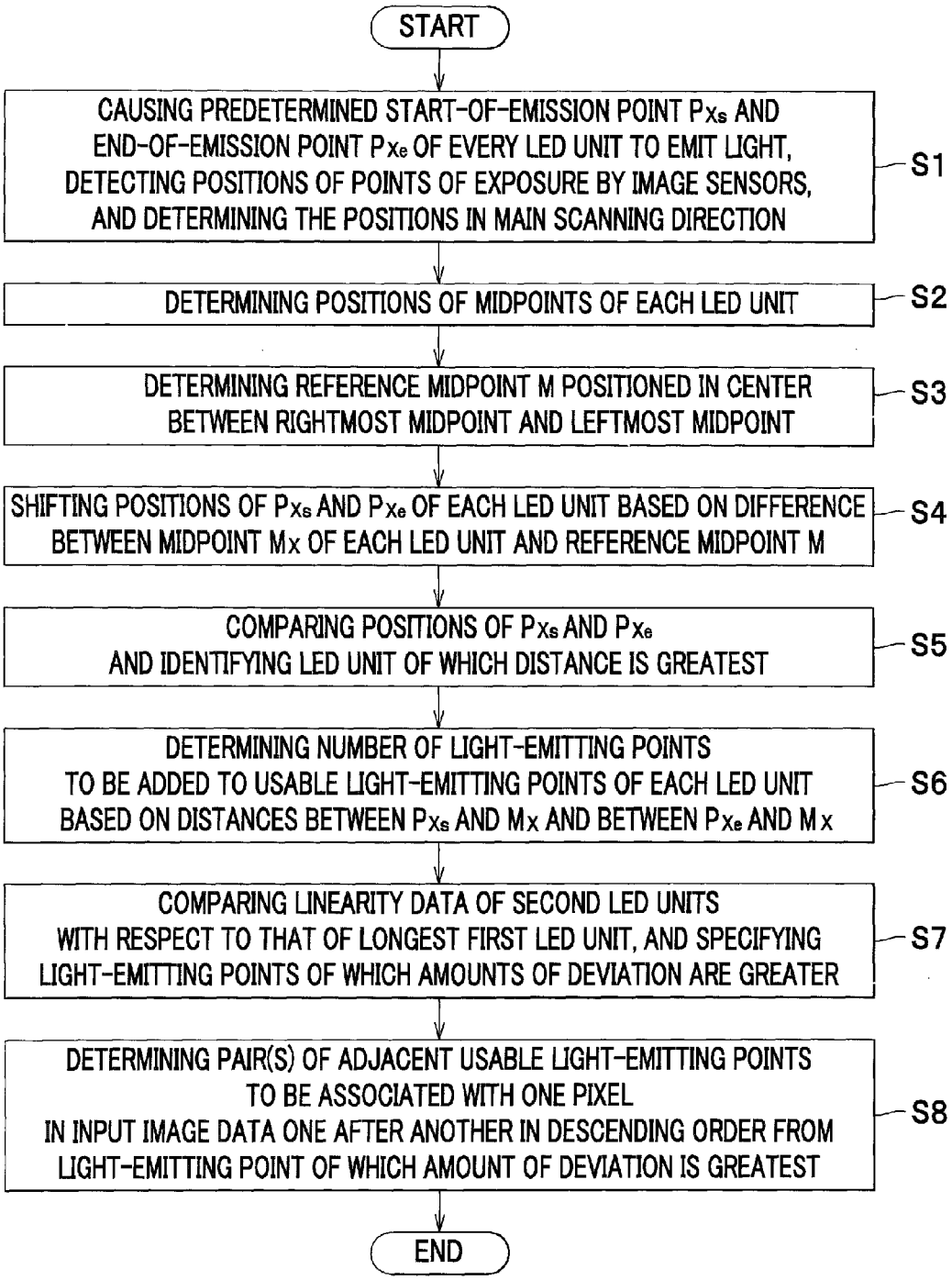
FIG. 6 is a flowchart showing a general flow of an operation for determination of light-emitting points associated with pixels.

In the color printer 1, the operation of determination of light-emitting points associated with pixels is initiated with predetermined timing, and carried out in accordance with the process shown in FIG. 6. This predetermined timing may preferably be related to the possibility of shifting of the LED units 40 from the body reference plane BL of the body of the color printer 1; for example, the operation is initiated in response to detection of opening/closing of the upper cover 12 by a sensor, or at a time when the power is turned on.

When the operation of determination of light-emitting points associated with pixels is initiated with timing predetermined as described above, first, as shown in FIG. 6, the end-pixel location unit 110 causes the predetermined start-of-emission point $P_{Xs}$ and end-of-emission point $P_{Xe}$ of every LED unit 40 to give off light emission. The photoconductor 53 is then exposed to light emitted from the start-of-emission point $P_{Xs}$ and end-of-emission point $P_{Xe}$ of each LED unit 40, and the position of the pixels of thus-developed image are detected by the image sensors 105. The end-pixel location unit 110 determines the positions in the main scanning direction of the points of exposure to light emitted from the start-of-emission point $P_{Xs}$ and end-of-emission point $P_{Xe}$ based on the data (detection signal) received by the controller 100 from the image sensors 105 (S1). In this step S1, for example, as shown in FIG. 7, the positions of the start-of-emission point $P_{Xs}$ ($P_{Bs}$, $P_{Ys}$, $P_{Ms}$, $P_{Cs}$) and end-of-emission point $P_{Xe}$ ($P_{Be}$, $P_{Ye}$, $P_{Me}$, $P_{Ce}$) of each LED unit 40 with respect to the body reference plane BL are determined.

Then, the center position determination unit 130 determines the position of a midpoint $M_B$, $M_Y$, $M_M$, $M_C$ between the positions in the main scanning direction of the points of exposure to light emitted from the start-of-emission point $P_{Xs}$ and the end-of-emission point $P_{Xe}$ of each LED unit 40 as determined by the end-pixel location unit 110 (S2; see FIG. 7).

Next, the center position determination unit 130 selects two midpoints $M_X$, of which one is located closest to the rightmost end and the other is located closest to the leftmost end, from the midpoints $M_B$, $M_Y$, $M_M$, $M_C$, and determines a center position in the main scanning direction (by taking a mean) between the two midpoints $M_X$ to thereby determine a reference midpoint (center of an image forming range) M (S3). For example, in the present embodiment as shown in FIG. 7, the center position between the midpoint $M_C$ and the midpoint $M_Y$ is determined to be the reference midpoint M.

Next, before bringing the ranges of the subsets of usable light-emitting points of the second LED units 40 into alignment with the range of the subset of usable light-emitting points of the first LED unit 40, the light-emitting point specification unit 140 brings the midpoints $M_X$ (of the ranges of exposure to light emitted from usable light-emitting points P) for the LED units 40 into alignment with one other. To be more specific, the start-of-emission point $P_{Xs}$ and the end-of-emission point $P_{Xe}$ of each LED unit 40 are shifted based on the difference in position between the midpoint $M_X$ of each LED unit 40 and the reference midpoint M (S4). For example, in the embodiment as shown in FIG. 7, the midpoint $M_Y$ for yellow is in a position shifted by more than half pitch (herein, the ideal pitch between adjacent light-emitting points P is assumed to be one pitch) to the right from the reference midpoint M, and the midpoint $M_C$ for cyan is in a position shifted by more than half pitch to the left from the reference midpoint M; therefore, the range of the subset of usable light-emitting points P of each LED unit 40 is shifted by the number corresponding to the shifted pitches to the right or to the left. Accordingly, as shown in FIG. 8, the range of the subset of usable light-emitting points P of the LED unit 40Y is shifted by one point to the left; that is, the rightmost one light-emitting point of the usable light-emitting points P of the LED unit 40Y is made unusable (excluded from the subset of usable light-emitting points P) and one light-emitting point located on the left end of and adjacent to the leftmost usable light-emitting point is incorporated into the subset of usable light-emitting points P. Similarly, the range of the subset of usable light-emitting points P of the LED unit 40C is shifted by one point to the right. In this way, the midpoints $M_B$, $M_Y$, $M_M$, $M_C$ are brought substantially into alignment with the reference midpoint M in the main scanning direction (falling within the tolerance smaller than half pitch).

Next, the maximum-width exposure device identification unit 120 compares the positions of the start-of-emission point $P_{Xs}$ and the end-of-emission point $P_{Xe}$ of each LED unit 40 to obtain a distance in the main scanning direction between these light-emitting points $P_{Xs}$, $P_{Xe}$ for each LED unit 40. The maximum-width exposure device identification unit 120 then identifies one LED unit 40 of which the distance between the two light-emitting points $P_{Xs}$, $P_{Xe}$ is greatest of all the LED units 40 (S5). In the present embodiment, as shown in FIG. 8, the LED unit 40 of which the distance between the two light-emitting points $P_{Xs}$, $P_{Xe}$ is greatest is the LED unit 40C for cyan, which is thus identified by the maximum-width exposure device identification unit 120.

Next, the light-emitting point specification unit 140 determines the number of light-emitting points P to be added to the number of usable light-emitting points P of each second LED unit 40B, 40Y, 40M other than the first LED unit 40C for cyan, based on the distances between the start-of-emission point $P_{Xs}$ and the midpoint $M_X$ and between the end-of-emission point $P_{Xe}$ and the midpoint $M_X$ (S6). The sum of the numbers of these distances designates the range of exposure for each second LED unit 40B, 40Y, 40M, and thus-calculated range of exposure for each second LED unit 40B, 40Y, 40M may be compared with the range of exposure for the first LED unit 40C. That is, the differences between the ranges of exposure for each second LED unit 40B, 40Y, 40M and for the first LED unit 40C may be divided by the ideal pitch of arrangement of the light-emitting points P so that the number of light-emitting points P to be added for each second LED unit 40B, 40Y, 40M may be determined. For example, as shown in FIG. 8, one light-emitting point P may be added to each of the subunits of usable light-emitting points P of the LED units 40B, 40Y for black and for yellow, and two light-emitting points P may be added to the subunit of usable light-emitting points P of the LED unit 40M for magenta. To be more specific, as shown in FIG. 9, one light-emitting point is added to the subset of usable light-emitting points of each LED unit 40B, 40Y for black and for yellow by incorporating a light-emitting point located adjacently at its right end, and two light-emitting points are added to the subset of usable light-emitting points of the LED unit 40M for magenta by incorporating two light-emitting point of which one is located adjacent to the right end of the subset and the other is located adjacent to the left end of the subset. In this way, determination as to the position of the light-emitting point P to be added (which light-emitting point should be selected, at the right end or at the left end) may be made by comparing the positions of the start-of-emission point $P_{Bs}$, $P_{Ys}$, $P_{Ms}$ and the end-of-emission point $P_{Be}$, $P_{Ye}$, $P_{Me}$ for each second LED unit 40B, 40Y, 40M with the positions of the start-of-emission point $P_{Cs}$ and the end-of-emission point $P_{Ce}$ for the first LED unit 40C (i.e., the determination may be made based on the differences between these position).

Next, the light-emitting point association unit 150 compares linearity data of each second LED array unit 40B, 40Y, 40M with the linearity data of the longest (maximum-width) first LED unit 40C, and specify one or more light-emitting points of which amounts of deviation are greater (S7). To be more specific, the linearity data stored in the memory 109 may be consulted and used in combination with information on the positions of the start-of-emission point $P_{Xs}$ and the end-of-emission point $P_{Xe}$ of each LED unit 40 so as to determine the positions in the main scanning direction of the light-emitting points P relative to the body reference plane BL for every LED unit 40. Assuming that the start-of-emission points $P_{Bs}$, $P_{Ys}$, $P_{Ms}$, $P_{Cs}$ are associated with the leftmost pixels on the coordinate in the image data, the positions of light-emitting points P of the second LED units 40B, 40Y, 40M are compared with those of the first LED unit 40C, sequentially toward the end-of-emission points $P_{Be}$, $P_{Ye}$, $P_{Me}$, $P_{Ce}$ so that the amounts of deviation in the main scanning direction can be calculated for each light-emitting point P. The light-emitting point association unit 150 selects one or more light-emitting points P of which the amounts of deviation are greater, wherein the number of light-emitting points P to be selected is equal to the number of light-emitting points to be added to the subset of usable light-emitting points P of each second LED unit 40B, 40Y, 40M.

Next, the light-emitting point association unit 150 determines at least one pair of adjacent usable light-emitting points to be associated with one pixel of the image data, one after another in the descending order from the light-emitting point of which the amount of deviation is greatest (S8).

Figure 10:
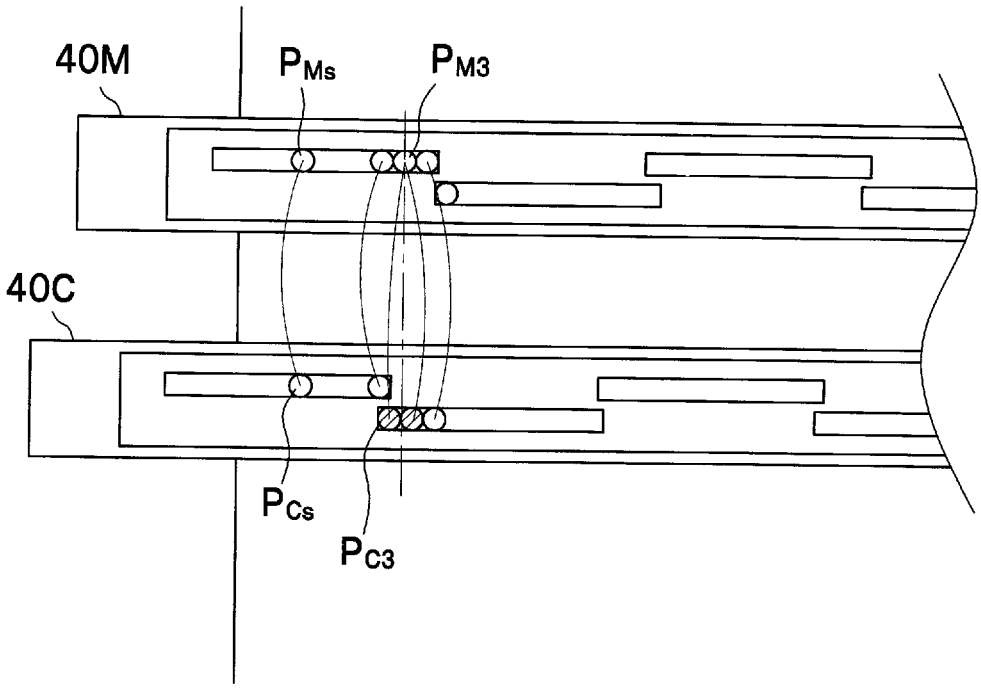
FIG. 10 is a schematic diagram of the LED units as viewed from the light-emitting side thereof, illustrated to show two adjacent light-emitting points associated with one pixel of image data in an example.

For example, let us assume that when the positions in the main scanning direction of the light-emitting points $P_C$ for cyan (of the LED unit 40C which is, in this example, one of the second LED units other than the first maximum-width LED unit 40M) are compared with the positions in the main scanning direction of the light-emitting points $P_M$ for magenta (of the LED unit 40M which is, in this example, the first LED unit as identified by the maximum-width exposure device identification unit 120), sequentially from the start-of-emission points $P_{Ms}$, $P_{Cs}$ toward the right, for example, as shown in FIG. 10, a light-emitting point $P_{M3}$ is in a position shifted from the position of a corresponding light-emitting point $P_{C3}$ by an amount of deviation greater than half pitch. The light-emitting point $P_{C3}$ of which the amount of deviation from the corresponding light-emitting point $P_{M3}$ is greater is paired with a light-emitting point adjacent thereto to make a pair of adjacent usable light-emitting points (indicated by hatched patterns in FIG. 10) to be associated with one pixel of the image data.

When every pair of adjacent usable light-emitting points to be associated with one pixel of the image data is determined through the process described above, the coordinates in the main scanning direction of the pixels of the image data and the light-emitting points or the pairs of light-emitting points associated with the coordinates are stored in the memory 109.

After the determination of light-emitting points associated with pixels is made in such a manner as described above, the controller 100 then activates the LED head driver unit 160 to cause each light-emitting point to selectively give off light emission (blink), thereby exposing the photoconductor drum 53 to light while referring to the coordinates in the main scanning direction of the pixels of the image data and the light-emitting points or the pairs of light-emitting points associated with the coordinates stored in the memory 109.

As described above, in the color printer 1 according to the present embodiment, the ranges (widths and positions) in the main scanning direction of the subsets of usable light-emitting points P of the LED units 40 are brought into alignment with each other by the light-emitting point specification unit 140, so that the ranges of exposure in the main scanning direction by emission of light from the light-emitting points of all the LED units 40 for different colors are aligned with each other, and thus a high-quality color image can be formed. It is to be understood that the alignment of the ranges of the subsets of adjacent usable light-emitting points P of the LED units 40 is achieved within the tolerance limit of half pitch. Furthermore, in this process of adjustment of exposure ranges, the light-emitting point specification unit 140 determines the number of light-emitting points to be added to each second LED unit 40 with reference to the range of the subset of usable light-emitting points of the first LED unit 40 of which the distance between the start-of-emission point $P_{Xs}$ and the end-of-emission point $P_{Xe}$ is greatest; therefore, the pixels to be printed would resultantly be lossless so that a high-precision color image can be formed.

In the color printer 1 according to the present embodiment, the controller 100 is configured to activate the end-pixel location unit 110, the maximum-width exposure device identification unit 120, the center position determination unit 130, the light-emitting point specification unit 140, and the light-emitting point association unit 150 to execute the respective operations, such as addition of light-emitting points, only during printing operation in a color printing mode, but not during printing operation in a monochrome printing mode. With this configuration, disturbance in the resulting image which would otherwise be generated during the printing operation in the monochrome printing mode can be prevented.

Furthermore, in the present embodiment, the center position determination unit 130 determines the center of image forming range and aligns the midpoints of the LED units 40 with that center wherein a mean between the midpoint $M_X$ located closest to the left end and the midpoint $M_X$ located closest to the right end is taken to obtain the reference midpoint M with which all the midpoints $M_X$ are to be aligned, and thus the process would not likely to abort due to shortage of light-emitting points P when the light-emitting point specification unit 140 specifies the subunits of usable light-emitting points. Accordingly, the number of extra light-emitting points P reserved for allowances outside the printable width in the main scanning direction can be reduced, so that the costs can be brought down.

Furthermore, in the present embodiment, if the number n of the light-emitting points P to be added to any of the second LED units 40 is more than one, the n pairs of adjacent usable light-emitting points P associated with one pixel in the image data are located with at least one other light-emitting point P interposed between the pairs, and thus disturbance in the resulting image can be prevented.

Furthermore, in the present embodiment, light-emitting points P of which the amounts of deviation are greater than other light-emitting points P are selected from those in each second LED unit 40, each of thus-selected light-emitting points P is to be paired with a light-emitting point P adjacent thereto to make a pair of adjacent usable light-emitting points P associated with one pixel in the image data; therefore, color misalignment would not likely to occur during printing in the color printing mode, so that high-quality color image can be formed.

Although an illustrative embodiment has been described above, the present invention is not limited to this specific embodiment, and various modifications or changes may be made practicably to the illustrated embodiment.

Figure 11A:
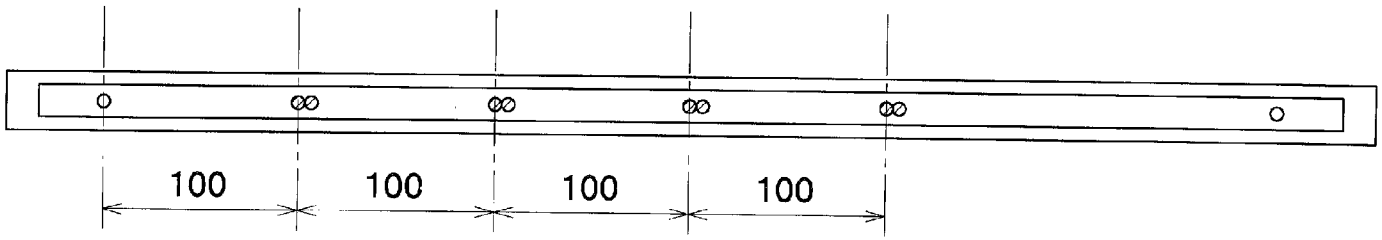
FIGS. 11A and 11B are schematic diagrams of the LED units as viewed from the light-emitting side thereof, illustrated to show how to position two adjacent light-emitting points associated with one pixel of image data.
Figure 11B:
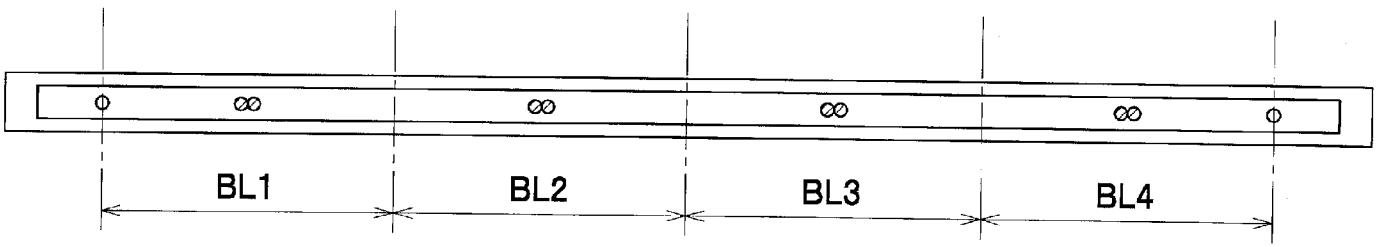

For example, the method of determining two adjacent light-emitting points to be associated with one pixel in the image data may be implemented in a different way. FIGS. 11A and 11B illustrate two alternative embodiments of arrangement of two adjacent light-emitting points to be associated with one pixel in the image data. In the example shown in FIG. 11A, the light-emitting point association unit 150 is configured such that, if the number n of light-emitting points to be added to the subset of usable light-emitting points in the LED unit 40 is more than one, one pair of light-emitting points located at a predetermined interval (e.g., one pair for every 100 light-emitting points) is assigned to be associated with one pixel in the image data.

In the example shown in FIG. 11B, the light-emitting point association unit 150 is configured such that, if the number n of light-emitting points to be added to the subset of usable light-emitting points in the LED unit 40 is more than one (e.g., n=4), the range of the subunit of adjacent usable light-emitting points is divided into n (e.g., four) divisional ranges (blocks BL1-BL4), and one pair of light-emitting points selected among light-emitting points located in each of these divisional ranges is assigned to be associated with one pixel in the image data. In this example of FIG. 11B, any pair of light-emitting points may be selected among light-emitting points in each block BL1-BL4 on condition that pairs to be selected should not be adjacent to each other (i.e., pairs are located with at least one light-emitting point interposed therebetween).

In the above-described embodiment and several modifications thereof, the relative positions in the main scanning direction of the pairs of adjacent usable light-emitting points among two or more second LED units 40 are not brought into focus, but it may be preferable that arrangement of the pairs of light-emitting points be determined with consideration given to the relative positions of the pairs among the LED units 40. To be more specific, the light-emitting point association unit 150 may be configured such that the pairs of adjacent usable light-emitting points P of all the second LED units 40 to be associated with one pixel in the image data are located in positions different from each other (the position of a pair of adjacent usable light-emitting points P to be associated in one pixel in one LED unit 40 is different from the position of a pair of adjacent usable light-emitting points P to be associated in one pixel in another LED unit 40).

Figure 12:
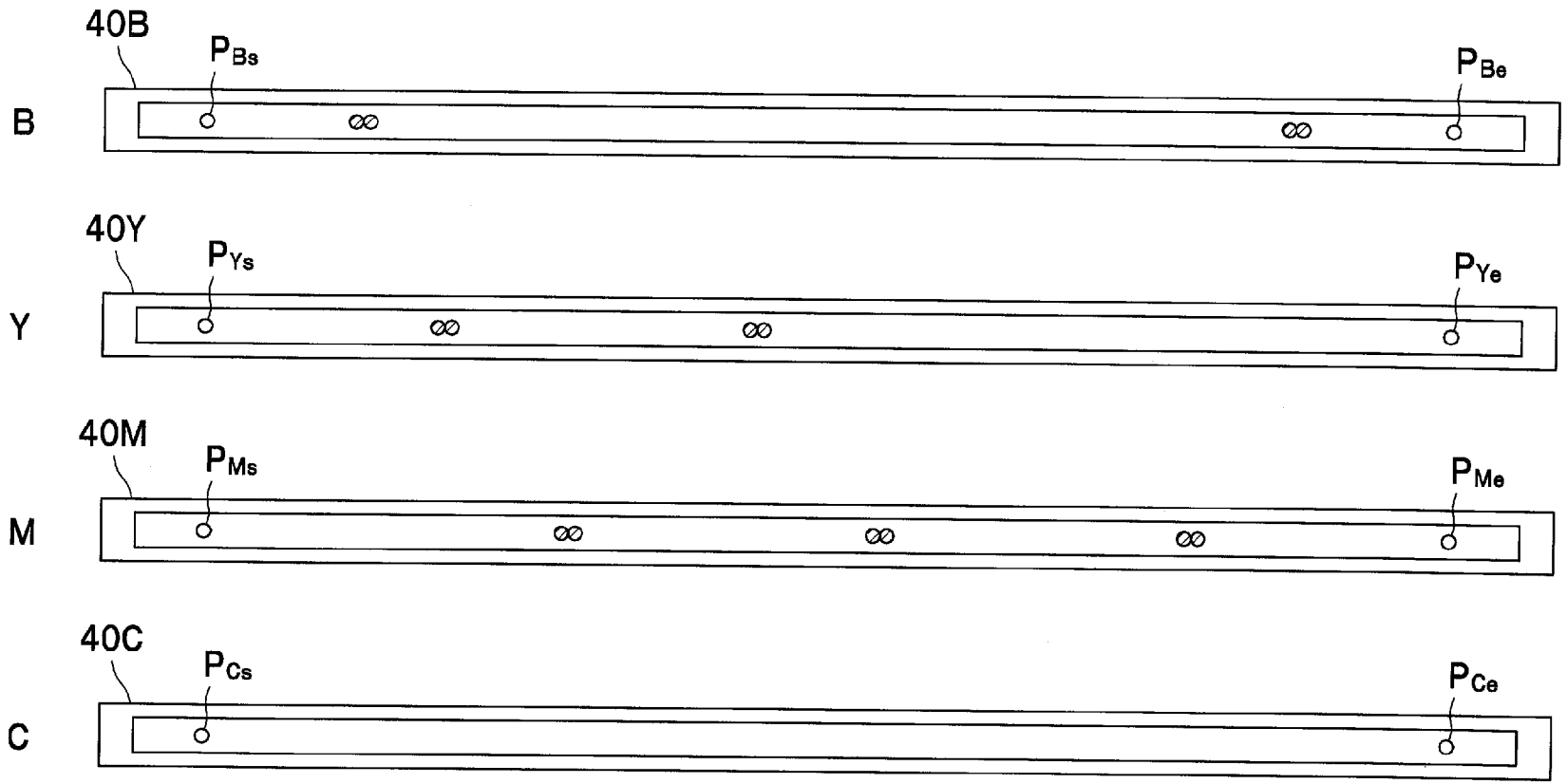
FIG. 12 is a schematic diagram for explaining a plurality of second LED units each having some pairs of adjacent light-emitting points each associated with one pixel of image data, pairs of light-emitting points being located in positions in the main scanning direction different from each other.

In an embodiment with this arrangement, as shown in FIG. 12, wherein the LED unit 40C for cyan is the first LED unit, the LED units 40B, 40Y, 40M for black, yellow and magenta are the second LED units, the positions of the pairs of adjacent usable light-emitting points P are arranged so as not to overlap each other in the main scanning direction. Accordingly, the pairs of adjacent usable light-emitting points P can be in scattered positions, so that a high-quality image can be formed.

Besides the above variations, the aforementioned embodiments may be modified where appropriate. For example, the memory (storage device) 109 may be provided in any part of the image forming apparatus, and data to be stored may be distributed among several locations. For example, the data stored in the memory 109 in the above-described embodiments may be stored in a memory 49 in the LED unit 40 (see FIG. 5), instead.

In the above-described embodiments, a plurality of LED elements are used to realize a plurality of light-emitting points included in each exposure device, but any light-emitting elements other than LEDs may be used, instead.

In the above-described embodiments, a photoconductor drum 53 is illustrated as an example of a photoconductor, but the photoconductor may be in the form of a belt.

In the above-described embodiment, the color printer 1 is shown as one example of an image forming apparatus, but the image forming apparatus to which the present invention is applicable is not limited thereto. For example, the image forming apparatus consistent with the present invention may include a photocopier and a multi-function peripheral.

What is claimed is:

1. An image forming apparatus comprising:

a plurality of exposure devices each having a plurality of light-emitting points arranged in a main scanning direction;

a photoconductor configured to be exposed to light emitted from the exposure devices whereby an electrostatic latent image is formed thereon; and a controller configured to control emission of the exposure devices;

wherein the controller includes:

an end-pixel location unit configured to determine positions in the main scanning direction of points of exposure to be formed on the photoconductor by emission of light from two light-emitting points of each exposure device, the two light-emitting points being in predetermined positions near endmost light-emitting points of a predetermined number of light-emitting points the number of which corresponds to the number of pixels to be arranged in a printable width;

a maximum-width exposure device identification unit configured to identify a first exposure device of which a distance between the two light-emitting points is greatest of all the exposure devices, based on the positions of the points of exposure determined by the end-pixel location unit;

a light-emitting point specification unit configured to specify a subset of usable light-emitting points of a second exposure device other than the first exposure device identified by the maximum-width exposure device identification unit, the specified subset of usable light-emitting points being located in positions corresponding to a range of exposure which coincides in a width direction with a range of exposure defined by the two light-emitting points of the first exposure device; and a light-emitting point association unit configured to associate the subset of usable light-emitting points specified by the light-emitting point specification unit with pixels of input image data, wherein n pairs of adjacent usable light-emitting points of the second exposure device are each associated with one pixel, and the number n of the pairs of adjacent usable light-emitting points is obtained by subtracting the number of usable light-emitting points of the first exposure device from the number of the usable light-emitting points of the second exposure device.

2. The image forming apparatus according to claim 1, wherein the light-emitting point association unit is configured such that if the number n is more than one, then pairs of adjacent usable light-emitting points associated with one pixel are located with at least one other light-emitting point interposed between the pairs in the second exposure device.

3. The image forming apparatus according to claim 2, wherein the light-emitting point association unit is configured to divide, if the number n is more than one, the range of exposure covered by the subset of the usable light-emitting points of the second exposure device into n ranges, such that the n pairs of adjacent usable light-emitting points associated with one pixel are located in ranges different from each other.

4. The image forming apparatus according to claim 1, wherein the light-emitting point specification unit is further configured to specify a subset of usable light-emitting points of each of one or more other second exposure devices of which distances between the two light-emitting points are not greater than that of the first exposure device, the specified subset of usable light-emitting points of each second exposure device being located in a position corresponding to a range of exposure which coincides in the width direction with the range of exposure defined by the two light-emitting points of the first exposure device, and wherein the light-emitting point association unit is further configured to associate the usable light-emitting points of each second exposure device with pixels of input image data, wherein n pairs of adjacent usable light-emitting points of each second exposure device are each associated with one pixel, and the number n of the pairs of adjacent usable light-emitting points is obtained by subtracting the number of the usable light-emitting points of the first exposure device from the number of the usable light-emitting points of the second exposure device, and wherein pairs of adjacent usable light-emitting points of all the second exposure devices to be associated with one pixel by the light-emitting point association unit are located in positions different from each other.

5. The image forming apparatus according to claim 1, wherein the controller is configured to activate the end-pixel location unit, the maximum-width exposure device identification unit, the light-emitting point specification unit, and the light-emitting point association unit only during printing operation in a color printing mode, and to associate light-emitting points with pixels of input image data on one-to-one basis by assigning the light-emitting points to the pixels of the input image data sequentially from a predetermined light-emitting point during printing operation in a monochrome printing mode.

6. The image forming apparatus according to claim 1, wherein the controller further includes a center position determination unit configured to determine a position of a midpoint between the positions in the main scanning direction of the points of exposure formed on the photoconductor by emission of light from the two light-emitting points of each exposure device as determined by the end-pixel location unit, and to determine a center of an image forming range by taking a mean between two midpoints of which one is located closest to one end and the other is located closest to the other end in the main scanning direction, and wherein the light-emitting point specification unit is further configured to redefine the range of exposure to light emitted from the usable light-emitting points of the first exposure device by shifting the usable light-emitting points into a range at which the same number of the usable light-emitting points are assigned to each side in the main scanning direction of the center of the image forming range, and to specify the subset of usable light-emitting points located in positions corresponding to the range of exposure which coincides with the redefined range of exposure to light emitted from the usable light-emitting points of the first exposure device.

7. The image forming apparatus according to claim 6, wherein the controller is configured to activate the end-pixel location unit, the maximum-width exposure device identification unit, the center position determination unit, the light-emitting point specification unit, and the light-emitting point association unit only during printing operation in a color printing mode, and to associate light-emitting points with pixels of input image data on one-to-one basis by assigning the light-emitting points to the pixels of the input image data sequentially from a predetermined light-emitting point during printing operation in a monochrome printing mode.

* * * * *